United States Patent [19]

Yeh

[11] Patent Number: 4,532,784

[45] Date of Patent: Aug. 6, 1985

[54] COMBINATION LOCK

[76] Inventor: Ching C. Yeh, No. 139, Sec. 2, Chang Hsing Rd., Ho Mei Chen, Changhua, Taiwan

[21] Appl. No.: 483,538

[22] Filed: Apr. 11, 1983

[51] Int. Cl.[3] ..... E05B 37/02

[52] U.S. Cl. ..... 70/312; 70/67; 70/317

[58] Field of Search ..... 70/67, 69, 70, 71, 312, 70/315–318

[56] References Cited

U.S. PATENT DOCUMENTS 1,410,033 3/1922 Pass ..... 70/317
1,497,793 6/1924 Saunders et al. ..... 70/312
4,343,163 8/1982 Scelba et al. ..... 70/312
4,441,346 4/1984 Castiglioni ..... 70/316 X

FOREIGN PATENT DOCUMENTS 456985 5/1949 Canada ..... 70/316

*Primary Examiner*—Gary L. Smith
*Assistant Examiner*—Russell W. Illich
*Attorney, Agent, or Firm*—Allen D. Gutchess, Jr.

[57] ABSTRACT

A novel combination lock, mainly comprising a bolt, a case, an actuating button, three steel balls, and a slotted rod, characterized in that the combination numbers can be randomly changed for security.

1 Claim, 16 Drawing Figures

FIG. 7A
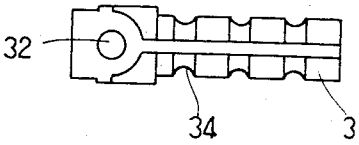
FIG. 7B
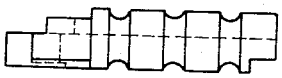
FIG. 7C
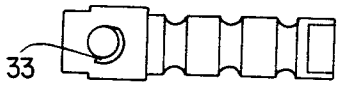
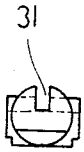
FIG. 7D
FIG. 8A
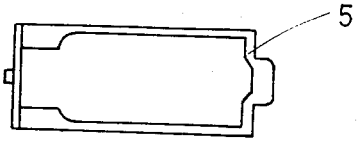
FIG. 8B
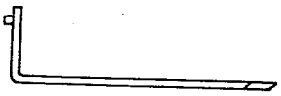
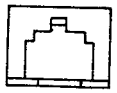
FIG. 8C
FIG. 9A
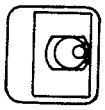
FIG. 9B
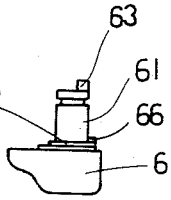
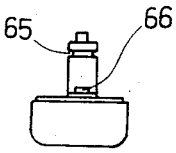
FIG. 9C

COMBINATION LOCK

BACKGROUND OF THE INVENTION

The combination lock has been known in Europe since at least the sixteenth century, and its origin are lost. The bolt or shackle in a combination lock has slots in it. A number of tumblers are provided with numbers or letters around the outside, and projections on the inside, which fit the slots. The rings must be lined up correctly in order for the shackle to be withdrawn. Most combination locks are designed so that the combination can be changed occasionally for security. However, changing the combination numbers of the combination lock is troublesome. It is, therefore, an object of the present invention to provide a novel combination lock which is easy to use.

SUMMARY

The present invention relates to a novel combination lock, and more particularly to one mainly comprising a bolt, a case, an actuating button, three steel balls, and a grooved rod, characterized in that the combination numbers of the combination lock can be changed at will for security. The combination lock according to the present invention is opened by turning a number of tumblers to carry a number of steel balls into the key way of a bolt. If the grooved rod of the combination lock is further moved by rotating an actuating button. The steel balls will go into the slots of the slotted rod, so that the tumblers can be rotated without carrying the steel balls; that is, the combination numbers of the combination lock can be changed for security.

FIGS. *7a–d,* show four views of the bolt of the preferred embodiment of the present invention;

FIGS. *8a–c* show three views of the mounting plate of the preferred embodiment of the present invention;

FIGS. *9a–c* show three views of the actuating button of the preferred embodiment of the present invention.

DETAILED DESCRIPTION OF THE PREFERRED EMBODIMENT

Figure 1:
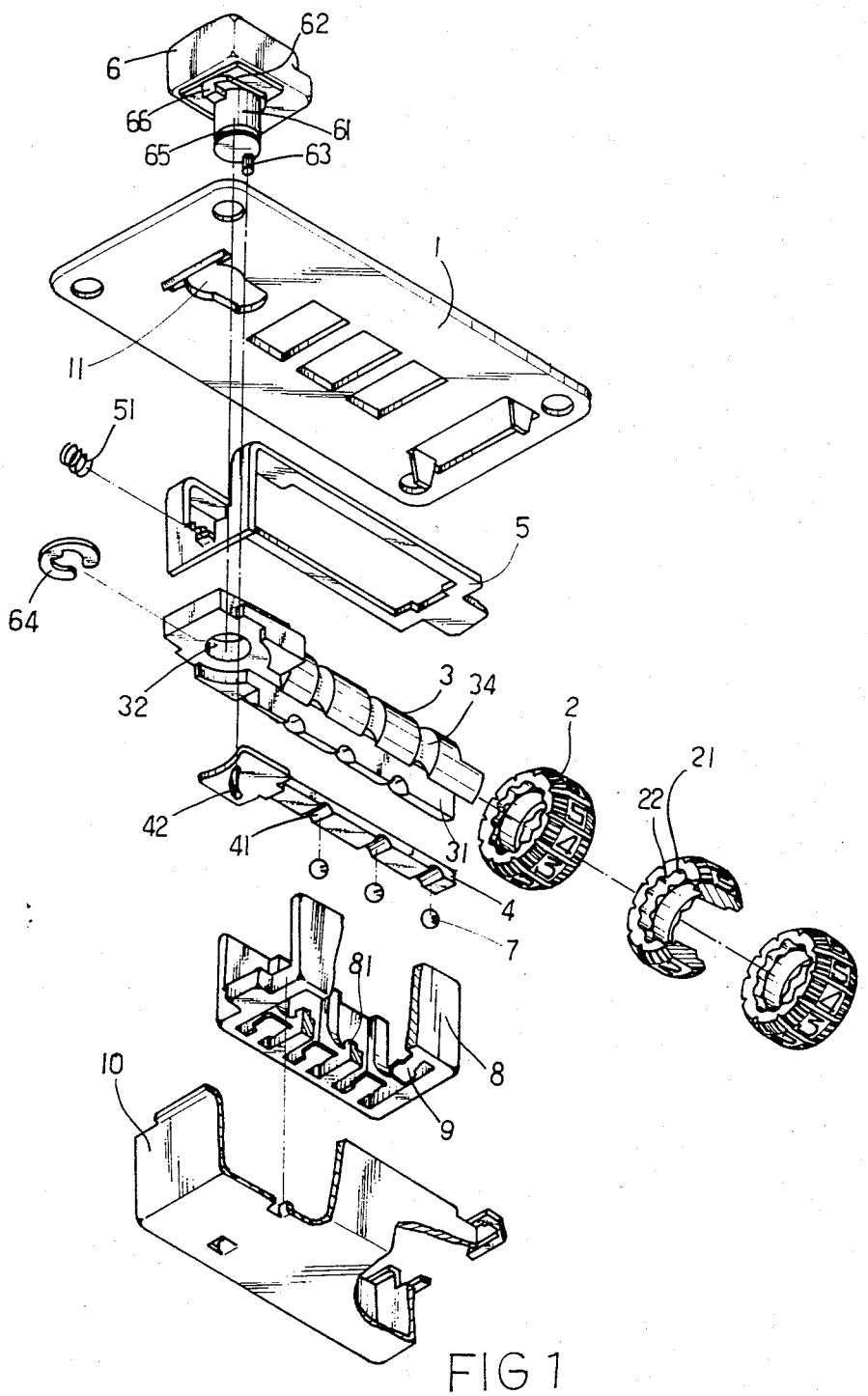
FIG. 1 is a fragmentary perspective view of a preferred embodiment of the present invention.
Figure 2:
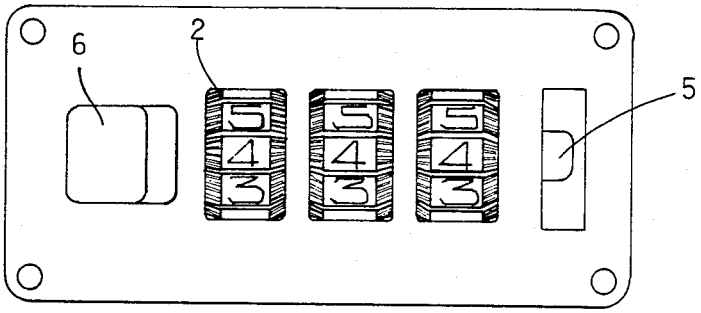
FIG. 2 is a top view of the preferred embodiment of the present invention.
Figure 3:
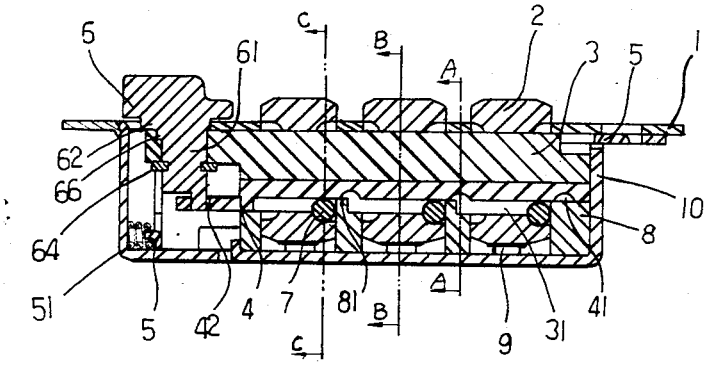
FIG. 3 is a full-sectional view of FIG. 2.
Figure 4:
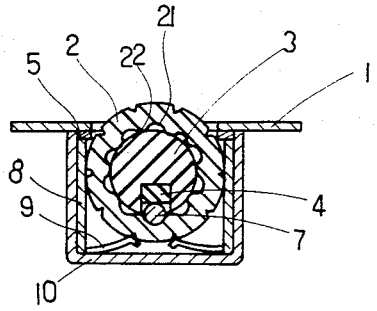
FIG. 4 is a sectional view taken along line C—C of FIG. 3.
Figure 5:
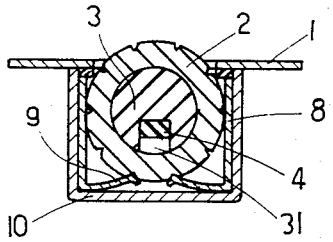
FIG. 5 is a sectional view taken along line B—B of FIG. 3.
Figure 6:
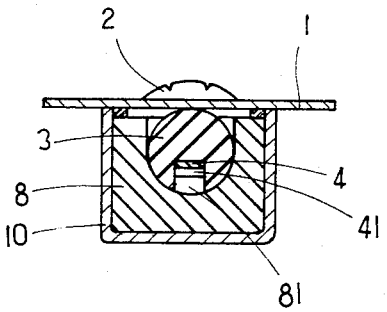
FIG. 6 is a sectional view taken along line A—A of FIG. 3.

Referring to the drawings , and particularly to FIG. 1 and FIG. 3, a grooved rod (4) is mounted into the key way of a bolt (3). The grooved rod (4) comes with a number of grooves (41) which are equal to the number of tumblers (2). The tumblers (2) are provided with numbers around the outside, and projections (22) on the inside, which fit annular, transverse grooves (34) of the bolt (3). The bolt (3) is placed on a mounting plate (5). The tumblers (2) fitted with the bolt (3) just encase the mounting plate (5). The actuating button (6) is provided with a protuberance (62) below which there is a pin (61) extending therefrom. When the combination lock according to the present invention is locked, a protuberance (62) of the actuating button (6) is restrained by a hole (11) of surface plate (1), so the actuating button is fixed slidably. The pin (61) just passes into a hole (32) of the bolt (3). The top of the pin (61) is provided with an eccentric pin (63). The eccentric pin (63) is inserted into slot (42) of the grooved rod (4). A retaining ring (64) is mounted into the groove (65) of the pin (61), so that the bolt (3), the mounting plate (5), the surface plate (1), and the actuating button (6) can be fixedly combined together. Three steel balls (7) are placed between the grooves (41) of the grooved rod (4) and the slots or notches (21) of the tumblers (2). Then, the combination is placed into a fixing frame (8) and then into a case (10). A number of plates (9) mounted on the fixing frame (8) are used to press the tumblers (2), so that the tumblers (2) can not be freely rotated. The assembly of the combination lock according to the present invention is now achieved.

When the present invention is locked, the steel balls (7) are located between the slots (21) of the tumblers (2) and the grooves (34) of the bolt (3); thus the bolt (3) cannot be withdrawn. If it is desired to open the combination lock according to the present invention, first turn the tumblers (2) to the positions where the steel balls (7) are moved to the keyway (31) of the bolt (3), and then move the actuating button (6), so that the bolt (3) is moved therewith; thus, the mounting plate (5) is moved, and the combination lock is opened. At that time, the protuberance (62) of the actuating button (6) is no longer restrained by the hole (11) of the surface plate (1), so that the actuating button (6) can be rotated through an angle of 90°. The rotated angle can be fixed, because the protuberance (66) is just placed into slot (33) of the bolt (3) (as shown in FIG. 7). When the actuating button (6) is rotated through an angle of 90°, the slotted rod (4) is driven back by the eccentric pin (63) of the actuating button (6). The steel balls (7) are obstructed by protuberances (81) of the fixing frame (8), so that the steel balls (7) fall into the slots (41) of the slotted rod (4) and are released from the projections (21) which lie between the slots (22) of the tumblers (2); namely, the tumblers (2) can be freely rotated, and the combination numbers can be changed for security.

In addition, we can use one hand to change the combination numbers of the combination lock according to the present invention. Since the actuating button (6) should be rotated through an angle of 90° before the combination numbers are able to be changed. This makes sure that the combination numbers cannot be changed owing to carelessness. Besides, by means of a spring (51), the mounting plate (5) can be moved backward and then sprung back when the actuating button (6) is not actuated, so that the tumblers (2) may be turned immediately after the combination lock is opened and it is unnecessary to line up again the correct numbers in order to lock the combination lock; thus, the duration of exposing the numbers is much decreased. In other words, the safety of the combination lock is increased.

Since the mounting plate (5) is not fixedly connected with the bolt (3), the safety of the present invention is increased.

Moreover, the actuating button (6) should be rotated an angle of 90° before the combination numbers are changed, so that the combination numbers would not be changed because of carelessness. Conclusively, the combination lock according to the present invention is indeed a novel combination lock.

I claim:

1. An improved combination lock comprising:

a surface plate having three holes respectfully for mounting three tumblers and an opening for mounting an actuating button having a pin, said opening being formed by two holes of different diameters in said surface plate connected by a slot of a width approximating the diameter of the smaller one of said two holes;

an actuating button having a protuberance adapted to be received in said opening and a pin extending below said protuberance, said pin having a groove engaged by a retaining ring and an eccentric pin extending below said groove, said actuating button being further provided with another protuberance for limiting rotating range thereof;

a mounting plate for installing a bolt, said mounting plate being connected with a spring at an end near said actuating button, one part of said mounting plate being at a right angle to another part of said mounting plate, said mounting plate having a protuberance at the end remote from said actuating button;

a bolt having a cylindrical main body, said bolt being provided with a keyway and three grooves extending therearound, said bolt having a planar surface near said actuating button, with said planar surface having a hole with a diameter similar to that of said pin of said actuating button;

a slotted rod formed with a plain surface on which there are a circular groove for mounting said eccentric pin of said actuating button and a rod on which there are three slots;

a fixing frame of rectangular shape and having means to accommodate said bolt and forming three compartments in which are mounted said tumblers associated with said bolt, said means having upwardly extending protuberances positioned to hold metal balls;

a metal ball for each of said grooves of said bolt;

a case for accommodating said fixing frame.

* * * * *

UNITED STATES PATENT OFFICE

CERTIFICATE OF CORRECTION

PATENT NO. : 4,532,784

DATED : August 6, 1985

INVENTOR(S) : Ching C. Yeh

It is certified that error appears in the above-identified patent and that said Letters Patent are hereby corrected as shown below:

In the specification:

Column 1, line 29, after "an actuating button" the "period" should be a --comma--.

Column 1, line 30, "The" should be --the--.

Column 2, line 3, "fixed slidably" should be --slidably fixed--.

Signed and Sealed this

*Twelfth* Day of *November 1985*

[SEAL]

*Attest:*

DONALD J. QUIGG

*Attesting Officer*

*Commissioner of Patents and Trademarks*